United States Patent [19]

Pastor

[11] 4,452,484

[45] Jun. 5, 1984

[54] WALKER

[76] Inventor: Peter M. Pastor, Lot 64, R.D. 3, Ridge Ave., Cardiff, N.J. 08232

[21] Appl. No.: 310,388

[22] Filed: Oct. 13, 1981

[51] Int. Cl.[3] ..... A47D 13/04

[52] U.S. Cl. ..... 297/6; 297/5; 297/150

[58] Field of Search ..... 297/150, 153, DIG. 4, 297/149, 6; 108/45; 248/224.3

[56] References Cited

U.S. PATENT DOCUMENTS

| | | | |
|---|---|---|---|
| 1,097,258 | 5/1914 | Noble et al. | 248/224.3 |
| 1,448,783 | 3/1923 | Blewitt et al. | 297/6 |
| 1,971,583 | 8/1934 | Skinner | 297/6 |
| 3,258,291 | 6/1966 | Ezquerra | 297/153 X |
| 4,097,089 | 6/1978 | Peterson | 297/440 X |
| 4,253,678 | 3/1981 | Leclerc | 297/6 |
| 4,373,756 | 2/1983 | Purdy | 297/149 X |

*Primary Examiner*—James T. McCall

*Attorney, Agent, or Firm*—Thomas C. Naber

[57] ABSTRACT

An improved walker, wherein the improvement comprises:

a. a tray having slidable supports removably mountable within brackets disposed on the rear legs of the walker, with said tray further having hooks engageable on a horizontal support rod of the walker for storage;

b. a removably mountable seat whose two lateral edges each extend beyond and rest upon support rods, with said seat having lateral movement stops to prohibit seat movement during use, and with said seat further having hooks engageable on a horizontal support rod of the walker for mounting or for storage; and c. a back rest disposed behind and mounted to an upper support rod extending between the legs at the front of the walker.

3 Claims, 6 Drawing Figures

WALKER

BACKGROUND OF THE INVENTION

This invention relates to an improved walker for the handicapped, said improvement comprising a back rest, seat, and adjustable tray.

The use of walking aids by persons unable to walk without support is well known. One such form of an aid is found in a pair of crutches, said crutches permitting a user to maintain elevation of one foot while accomplishing movement from one site to another. A second type of walking aid is a cane. The cane, of course, provides additional support to one side of a user's body and enables him to reduce support dependency on one of his legs.

A third type of walking aid is a walker. A walker is usually a support frame device which is generally U-shaped when viewed from above and provides support to an individual stationed within its boundaries. From beneath the general top frame members extend in some manner four braced and supported legs spaced from each other to create a generally box-like frame enterable from the rear. Height of the legs is such that a user can place his hands at the top of the walker and use the walker for support as he moves about.

Since a person using a walker is physically unable to walk normally, there is also a likelihood that the user will become fatigued easily. In many instances, however, there may be no convenient place for him to sit down when fatigue strikes. Likewise, the user may be so dependent upon his walker for mobility that he cannot comfortably leave it when eating or otherwise using his hands.

It is therefore evident that a need is present for a walker which incorporates certain user conveniences. Previous walkers have been shown in the following U.S. Patents. U.S. Pat. No. 4,212,493 shows a walker with a seat and knee pad. When the seat is in use, it closes the back of the walker. A U-shaped tray is mounted on the top rail of the frame. U.S. Pat. Nos. 3,957,071 and 4,074,683 each shows a walker with a tray disposed at the front. U.S. Pat. No. 3,993,349 shows a walker having a support device somewhat like a sling for use as a back rest if the user is sitting on a bed, for example, or as a type of seat. U.S. Pat. No. 2,776,701 shows a wheeled walker-type device having a seat across the back thereof and a tray in front. Finally, U.S. Pat. No. 1,448,783 shows a wheeled walker device having a seat which can be folded upwardly for non-use.

My improved walker disclosed herein provides for superior user comfort through incorporation of a secured seat safely immovable when in use, a mountable tray which is slidably adjustable for distance from the user, and a back rest placed for comfortable use while the user is seated in the walker.

SUMMARY OF THE INVENTION

The subject of the instant invention concerns an improvement in a walker, said walker comprising two parallel lateral essentially horizontal frame members wherein each frame member has extending downwardly therefrom two legs with an upper support rod and a lower support rod disposed between said legs and with each leg in line with the other and wherein an upper support rod and a lower support rod each extend between the legs at the front of the walker to thereby create a walker having two front legs and two rear legs. The improvement comprises:

a. a tray having slidable support means removably mountable within brackets disposed on the rear legs of the walker, with said tray further having hook means engageable on a support rod;

b. a removably mountable seat whose two lateral edges each extend beyond and rest upon a respective lower support rod of the legs of each horizontal frame member, with said seat having lateral movement stop means and further having hook means engageable on a support rod; and c. a back rest disposed behind and mounted to the upper support rod extending between the legs at the front of the walker.

The walker can have height adjustment means to facilitate comfortable use by respective persons of varying statures. Additionally, for portability, each of the upper and lower support rods which extend between the legs at the front of the walker can comprise two halves removably secured at their meeting sites. In such an embodiment, the back rest mounted to the upper of said support rods is longitudinally halved, resulting in said embodiment having the potential to be disassembled into two halves for convenient housing in a confined space.

Three attributes common to the instant walker are convenience, comfort, and safety. Convenience is found in the portability and ease of disassembly which can be experienced in one embodiment; in the adjustability of closeness of the tray to the user; and in the ease of storage of the seat and the tray utilizing respective hook means thereon when the user is employing the walker as a walking aid. Comfort is found in use of the back rest and seat as the user rests, and in the height adjustment means of the entire walker which can be incorporated in an embodiment. Safety is found in the seat and the incorporation therewith of stop means which prevent any lateral seat movement while in use. Additionally, placement and size of the seat is such that longitudinal movement is also prevented while the seat is in place. It is preferred that all connection means and height adjustment means be accomplished with threaded bolt and nut securement for safety rather than through utilization of push button and spring arrangements. The instant walker thus promotes user well-being irrespective of specific facilities available at any particular location.

DETAILED DESCRIPTION OF A PREFERRED EMBODIMENT

Figure 1:
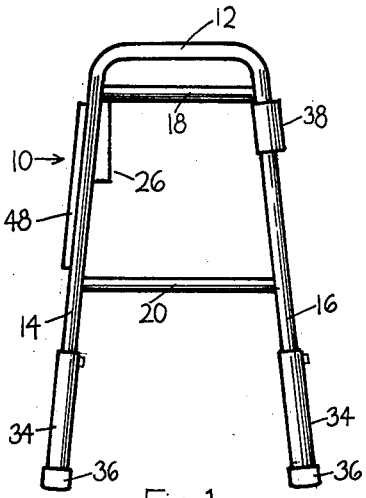
FIG. 1 is a side elevational view of a walker.
Figure 2:
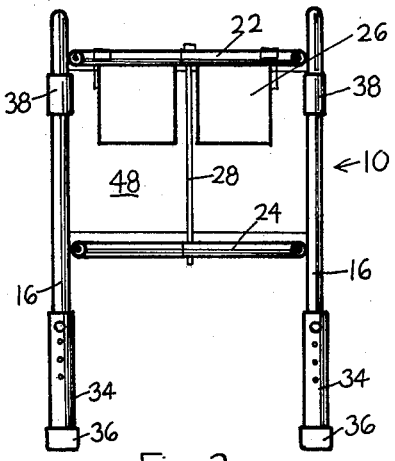
FIG. 2 is a rear elevational view of the walker of FIG. 1.
Figure 3:
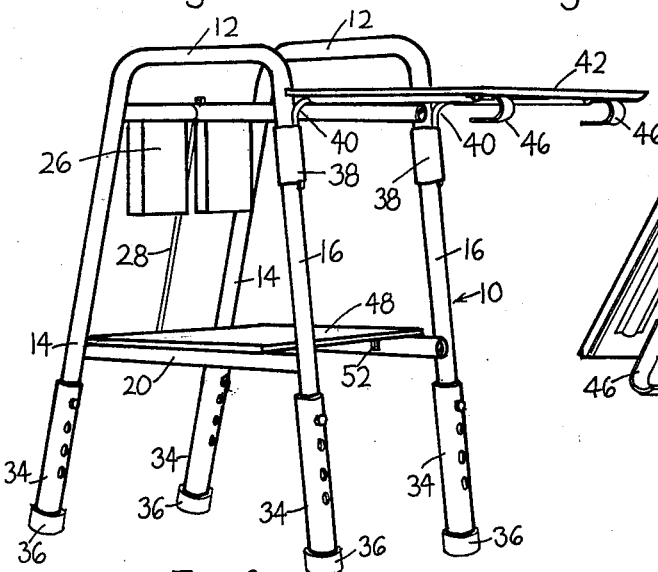
FIG. 3 is a perspective view of the walker of FIGS. 1 and 2, showing a seat and tray in position.

Referring to FIGS. 1–3, a walker 10 is shown. The walker 10 comprises two parallel lateral essentially horizontal frame members 12 around which a user places his hands. Extending downwardly from each frame member 12 are two legs 14, 16. An upper support rod 18 and a lower support rod 20 are disposed between said legs 14, 16. Each leg 14 is in line with the other leg 16. An upper support rod 22 and a lower support rod 24 each extend between the legs 14 at the front of the walker 10 to thereby construct a walker 10 having two front legs 14 and two rear legs 16.

Figure 6:
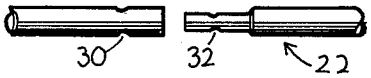
FIG. 6 is a front elevational view of a portion of a support rod disposed at the front of the walker of FIGS. 1–3.

Mounted to and disposed behind the upper support rod 22 is a back rest 26 consisting of two padded rigid cushions. In the embodiment shown, both the upper support rod 22 and lower support rod 24 comprise two halves removably secured at their respective center meeting sites. A vertical support rod 28 extends between the two horizontal support rods 22, 24. In FIG. 6 is shown the connection manner of the support rod 22, which is identical for the support rod 24. Each half of the support rod 22 or 24 is joined and the holes 30, 32 are registered with each other. A threaded bolt and nut are then used to maintain the connection securely. Such an arrangement promotes disassembly of the walker 10 into two halves for more convenient storage in a confined space such as an automobile trunk.

Height adjustment of the walker 10 is accomplished via leg base members 34 at the end of each of the legs 14, 16. The leg base members 34 are each slidable onto the legs 14, 16 and have holes which register with corresponding holes appropriately disposed near the bottom of the legs 14, 16. When the desired height of the walker 10 is attained, a threaded bolt and nut are utilized to maintain placement of the leg base members 34. It is preferred that rubber or similar non-slip cups 36 be disposed over the respective ends of the base members 34 to prevent undesired slipping of the walker 10.

Figure 4:
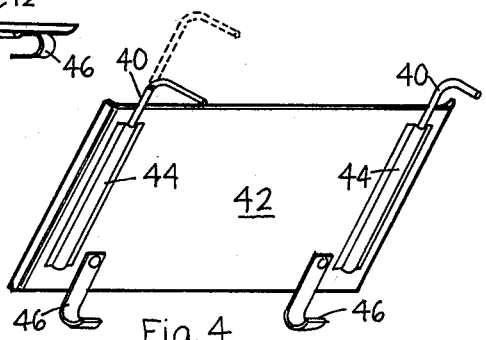
FIG. 4 is a bottom perspective view of the tray shown in FIG. 3.

On each of the rear legs 16 of the walker 10 is disposed a bracket 38 having a cylindrical opening in which a portion of a slidable support rod 40 from a tray 42 can be removably mounted. In FIG. 3 the tray 42 is mounted, while in FIG. 4 the tray 42 is shown alone. Each rod 40 is disposed within a bracket 44 mounted to the underside of the tray 42. The rods 40 can slide within the bracket 44 so that the tray 42, when mounted, can be moved to achieve variable distances from the rear legs 16 of the walker 10. FIG. 4 shows in phantom lines one of the rods 40 in an extended position. The rods 40 are snugly fit within the brackets 44 so that they do not fall out of the brackets 44 when the tray 42 is hanging for storage on any of the horizontal support rods through utilization of hooks 46 disposed on the underside of the tray 42.

Figure 5:
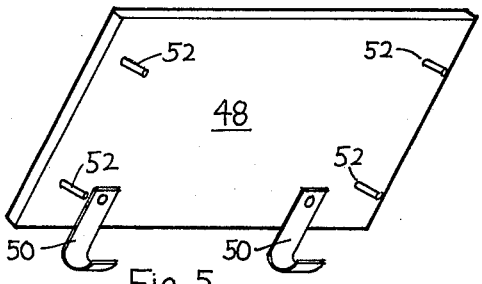
FIG. 5 is a bottom perspective view of the seat shown in FIG. 3.

A seat 48 is shown removably mounted in FIG. 3 and alone in FIG. 5. To mount the seat 48, it is placed so that its hooks 50 engage the lower support rod 24 extending between the two front legs 14 while its lateral edges rest on the lower support rods 20 extending between the front legs 14 and rear legs 16. Lateral movement of the mounted seat 48 is prohibited via stop means here consisting of peg-shaped cylinders 52 projecting from the underside of the seat 48. When the seat is properly mounted, these cylinders 52 reside in close proximity to the inner surfaces of the two lower support rods 20. Lateral movement of the seat 48 is thus prohibited since the cylinders 52 cannot move beyond the lower support rods 20. Longitudinal (forward-backward) movement of the seat 48 is also prohibited since the vertical support rod 28 prevents movement in that direction while the hooks 50 prevent movement in the opposite direction. As with the tray 42, the seat 48 can be hung from a horizontal support rod and is shown in FIG. 1 hanging from the upper support rod 22 extending between the two front legs 14.

In use as a walking aid, the seat 48 and tray 42 are hung from a support rod and the user uses the walker 10 in regular fashion. In use for resting, the seat 48 is positioned as earlier described and the user sits down thereon, simultaneously resting his back against the back rest 26. Should the seated user wish use of the tray 42 to hold food, papers, etc., said tray 42 is mounted as earlier described. The user can then slidably adjust the distance of the tray 42 from himself.

The walker 10 is preferably constructed of a light weight strong material. In the preferred embodiment aluminum is primarily employed, with tubular aluminum employed in the frame members, legs and leg base members, and support rods. The seat 48 and back rest 26 can be padded as desired and covered with fabric or plastic material to provide user comfort.

It is to be understood that the above description of the embodiment shown is illustrative and not limiting, and that the scope of the invention is defined in the claims which follow.

What is claimed is:

1. In a three-sided walker comprising two parallel essentially horizontal frame members wherein each frame member has extending downwardly therefrom two legs with an upper support rod and a lower support rod disposed between said legs and with each leg in line with the other and wherein an upper support rod and a lower support rod each extend between the legs at the front of the walker to thereby create a walker having two front legs and two rear legs, wherein the improvement comprises:

a. a tray having slidable support means removably mountable within brackets disposed on the rear legs of the walker, with said tray further having hook means engageable on a support rod;

b. a removably mountable seat whose two lateral edges each extend beyond and rest upon a respective lower support rod of the legs of each horizontal frame member, with said seat having lateral movement stop means and further having hook means engageable on a support rod; and c. a back rest disposed behind and mounted to the upper support rod extending between the legs at the front of the walker.

2. A walker as claimed in claim 1 having in addition height adjustment means.

3. A walker as claimed in claim 1 wherein each of the upper and lower support rods which extend between the legs at the front of the walker comprises two halves removably secured at their meeting sites and wherein the back rest mounted to the upper of said support rods is longitudinally halved.

* * * * *